US006027119A

United States Patent [19]

De Lisle

[11] Patent Number: 6,027,119

[45] Date of Patent: Feb. 22, 2000

[54] METHOD FOR PLAYING A CARD GAME

[75] Inventor: Wilhelm A. De Lisle, Paradera, Aruba

[73] Assignee: Sirio Brozzi Simonazzi, Italy

[21] Appl. No.: 09/130,382

[22] Filed: Aug. 6, 1998

[51] Int. Cl.[7] ..... A63F 1/00

[52] U.S. Cl. ..... 273/292; 463/12

[58] Field of Search ..... 273/292, 274, 273/143 R; 463/12

[56] References Cited

U.S. PATENT DOCUMENTS

| | | | |
|---|---|---|---|
| 5,275,415 | 1/1994 | Wisted | 273/274 |
| 5,324,041 | 6/1994 | Boylan et al. | 273/292 |
| 5,566,946 | 10/1996 | Parker | 273/292 |
| 5,605,333 | 2/1997 | Field | 273/274 |
| 5,613,682 | 3/1997 | Otuzbiryan | 273/292 |
| 5,632,487 | 5/1997 | Nguyen | 273/274 |
| 5,653,445 | 8/1997 | Quach | 273/292 |
| 5,944,314 | 8/1999 | Stavinsky | 273/292 |

OTHER PUBLICATIONS

"Thirty–Five", "Thirty–One", "Trente et Quarante", "Thirty–Four", Scarne's Encyclopedia Of Games, John Scarne, Harper & Row, Publishers, pp. 322–326, 1973.

*Primary Examiner*—Benjamin H. Layno

*Attorney, Agent, or Firm*—Philip J. Anderson; Quirk & Tratos

[57] ABSTRACT

A method for playing a card game is set forth wherein a player makes an ante wager to participate in the game. A five card hand is dealt to each player and the dealer. The player's and dealer's hand are valued by determining the suit with the highest point value where Kings, Queens and Jacks count as 10 points, Aces count as 11 points and all other cards have their face value. If the player elect to stay in the game they place a call bet, otherwise they lose their ante wager and are out of the hand. For those player's making the call bet, hands are resolved where if the player's hand value exceeds the dealer the player is the winner, if the dealer's hand has a qualifying point value and exceeds the player's hand point value the player is a loser and tie point values are declared ties.

12 Claims, 1 Drawing Sheet

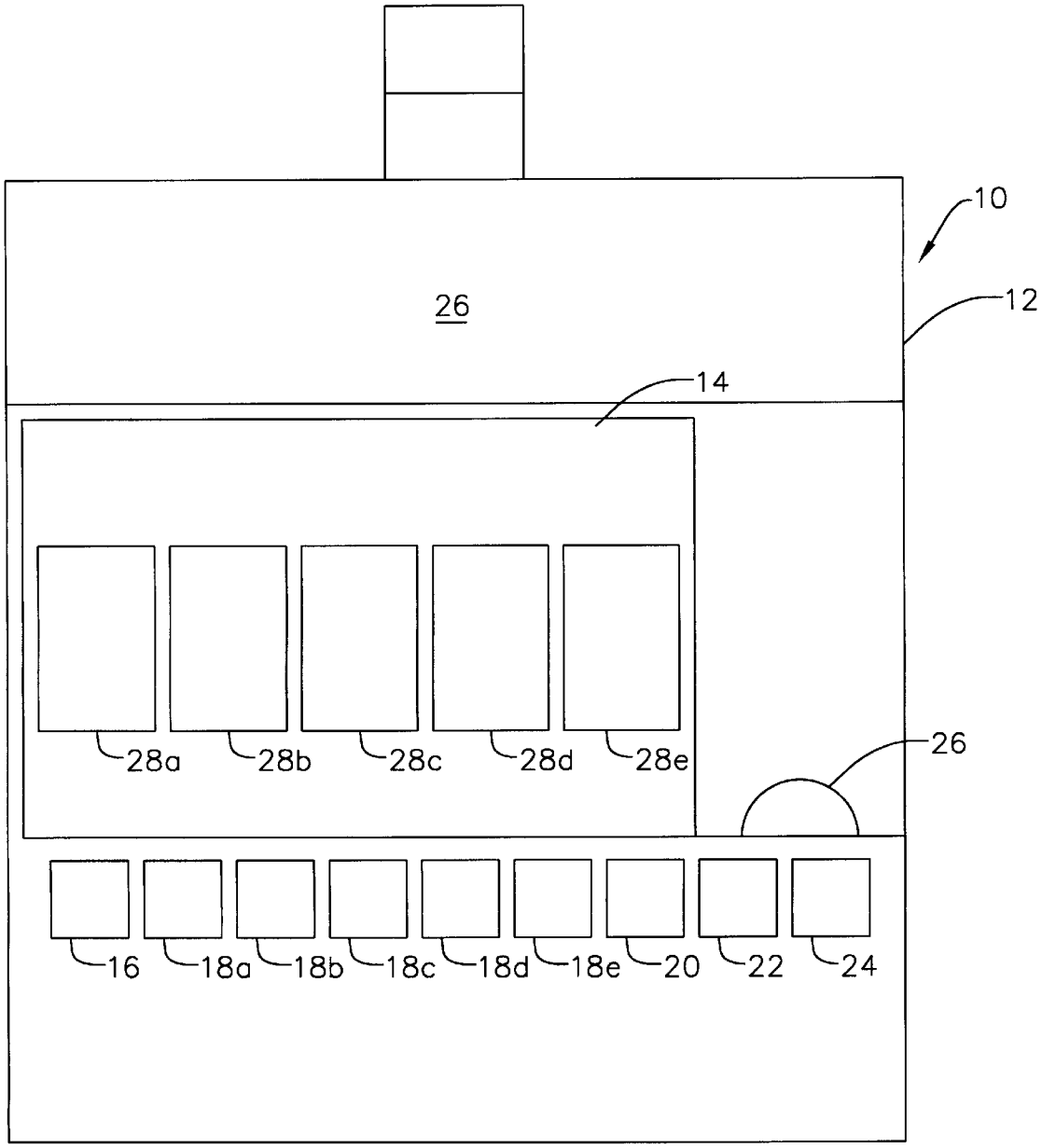
10
12
26
14
28a
28b
28c
28d
28e
26
16
18a
18b
18c
18d
18e
20
22
24

METHOD FOR PLAYING A CARD GAME

FIELD OF THE INVENTION

The present invention relates to casino games and devices played in a live game format using one or more decks of playing cards and ti devices adapted to present representations of playing cards for the play of a game.

BACKGROUND

Numerous card games have been developed for play in a casino. Such games include, in a live game format, Poker, Pai Gow, Blackjack and Baccarat to name but a few. These games provide a player with an opportunity to make a wager and, if the player is declared the winner, receive a return on their wager.

In a video format, games have been developed such as Video Poker, Video Blackjack, again just to name a few. These games and electronic devices are adapted to receive a wager and produce an outcome, which may be a losing outcome where the player loses their wager and a winning outcome where the player is paid based upon their wager.

Many such live, table games such as Blackjack and Pai Gow do not provide the player with an opportunity to win amounts many times their wager. Many games do not permit players to increase their wagers based upon the initial holding, with Poker being an exception.

There is a need for a new game which is easy to play, which can be played in both a live, table game format, which provides the player with the opportunity to increase their wager on their initial hand and which provides the player with the opportunity to win amounts many times their wager.

SUMMARY OF THE INVENTION

There is, therefore, set forth according to the present invention a method for playing a live table game and a table or video game which is easy to play, which provides, according to several embodiments, the player with the opportunity to increase their wager and which provides the opportunity to receive payouts several times the amount wagered.

According to one embodiment, the method includes the player making an ante wager to participate in the game. Five cards are dealt to the Dealer and the Player, each of the hands having a value determined by the suit of the highest summed point value where, (1) Kings, Queens and Jacks count as 10 points, (2) Aces count as 11 points, and (3) all other cards have a point count corresponding to their face value.

That is, only the suit producing the highest value is considered. The Player assesses their holding and opts to place a call bet to continue play or fold. If the Player folds the Player's Hand declared the loser and the Player's ante wager is collected by the Dealer. After the Player(s) have placed their call bets each of the Player's Hands is resolved in order against that of the Dealer according to the following rules, (1) if the Dealer's Hand does not have a qualifying value of at least a predetermined amount, the Player's Hand declared the winner, (2) if the Player's Hand has a higher value than the Dealer's Hand, the Player's hand is declared the winner, (3) if the Player's and Dealer's Hand having the same value, the hands declared a tie.

Where the Player's hand is declared the winner, the Player is paid based upon their wagers. Preferably the Players are paid even money (1:1) for the ante wager and at greater payouts for their call bet depending upon the value of the Player's Hand thus affording the opportunity for the Player to receive a large payout for their wager.

For a video or other table game version, the method includes the player making a wager and dealing five cards from a deck to the Player to define an initial holding having a value determined by the suit of the highest summed point value where, (A) Kings, Queens and Jacks count as 10 points, (B) Aces count as 11 points, and (C) all other cards have a point count corresponding to their face value.

Where the game is played by a processor driven gaming machine, the card data is randomly selected from memory and representations of cards are displayed at a video display as the initial holding. The Player opts to discard 0–5 of the cards of the initial holding and any discarded cards are replaced from the deck with replacements to define a final holding having a final value. If the final value exceeds a preselected amount such as twenty-four, the player wins their wager and obtains a payout which may be many times their wager depending upon the value of their hand.

BRIEF DESCRIPTION OF THE DRAWING

These and other features and advantages will become better appreciated with reference to the specification, claims and drawing which shows a device for playing the game according to one embodiment of the present invention.

Description

According to one embodiment, the method of the present invention may be practiced in a live, table game version. According to this embodiment a Dealer, such as a casino employee, is stationed at a game table which may be in the shape of a semi-circular Blackjack table well known in the art. Opposite the Dealer are a plurality of positions to be occupied by Players of the game. While the method contemplates that a number of Players may simultaneously play against the Dealer, the following description will referto a single Player competing against the Dealer.

Inasmuch as the method is well suited for play in a casino, it should be understood the in this case the casino, as represented by the Dealer, pays all winning wagers and collects all losing wagers. Thus the Players are playing against the casino and not against one another.

To play the game according to this embodiment of the present invention, a deck of playing cards is provided. If desired, one or more decks of cards may be used and dealt from a shoe. The deck of cards includes the traditional fifty-two cards, 2—Ace for each of the four suits of Clubs, Diamonds, Hearts and Spades.

After the cards have been shuffled, the game is ready for play. The Player first makes an ante wager of an amount which may be dictated by table minimums and maximums. To illustrate the play according to the method it will be assumed that the Player has made a 5—Dollar ante wager. After the Player has made the ante wager, the Dealer deals five cards to the Player constituting the Player Hand and five cards to himself constituting the Dealer Hand. The Dealer's Hand is dealt face down. The Player's Hand may be dealt face-up or face down. Subsequent to the deal, the Player examines the Player's Hand and determines its value according to the method of the present invention. To evaluate his hand, points are assigned to each card according to the following: Kings, Queens and Jacks each count as ten points, Aces count as eleven points and all other cards have a point count equal to their face value, e.g. a 7♡ counts a seven points. The Player sums the points for each suit and the suit with the highest point sum constitutes the value of the Player's Hand. The following examples are illustrative to show the determination of the hand value.

| Cards | Hand Values |
|---|---|
| 1. Q♠9♠5♡6♡7♢ | = 19 points (Q♠ + 9♠) |
| 2. 2♠3♠4♠K♠8♢ | = 19 points (2♠ + 3♠ + 4♠ + K♠) |

Depending upon the assessment, the Player may decide to continue play or fold. If the Player folds, the Dealer collects the Player's Hand and the ante wager. If the Player decides to continue he must place an additional, call bet greater than the ante wager and preferably twice the amount of the ante wager, or 10-Dollars in the present example. At this point the Player's Hand and Dealer's Hand are compared and resolved to determine if the Player is to be declared as having a winning outcome versus the Dealer and whether the Player's Hand has a point value sufficient to entitle the Player to an additional payout.

The Dealer exposes the Dealer's Hand and a point value is determined according to the rules discussed above with reference to the Player's Hand. If the Dealer's Hand does not have at least a point value of 18, the Dealer's Hand does not qualify and the Player's Hand is declared to be the winner. For non-qualifying Dealer Hands, the Player is paid even money for their ante wager and there is no action concerning the call wager since it is neither won nor lost and the Player is free to remove the call wager from the table. The cards are collected and new ante wagers are placed and the next hand is dealt.

If the Dealer's Hand qualifies by having a point value of 18 or greater, the Dealer's Hand point value is compared to the point value of the Player's Hand. The hand with the higher point value is declared the winner of the ante wager. If the Dealer's Hand is declared the winner, both of the Player's ante and call wagers are lost and are collected by the Dealer. The Player's Hand is also taken by the Dealer and play is over for the hand. If the Player's Hand is declared the winner by having a greater point value than the Dealer's Hand, the Player is paid even money for their ante wager and is paid for their call wager according to the schedule of Table 1.

TABLE 1

| Player's Hand Value | Payout |
|---|---|
| 51 | 100:1 |
| 50 | 50:1 |
| 47–49 | 20:1 |
| 42–46 | 10:1 |
| 40–41 | 7:1 |
| 35–39 | 5:1 |
| 32–34 | 3:1 |
| 29–31 | 2:1 |
| 18–28 | 1:1 |

Thus if the Player's Hand was declared the winner with a point value of 30 points, he would be paid $5 for his $5 ante wager and $20 for his $10 call wager. After the wagers have been paid the cards are collected and removed from play.

If the hands have the same point value, the Dealer's and Player's Hands, the rankings of the cards are compared to see which hand has the highest ranking card(s). In ranking the cards the following schedule is referred to:

| Card Ranking Schedule |
|---|
| 1. Ace (highest ranked card) |
| 2. King, Queen, Jack, 10 (ranked the same) |
| 3. 9's |
| 4. 8's |
| 5. 7's |
| 6. 6's |
| 7. 5's |
| 8. 4's |
| 9. 3's |
| 10. 2's (lowest ranked card) |

For example, if the Dealer's Hand and Player's Hand have the following cards;

| | |
|---|---|
| Dealer's Hand | Q♠9♠5♡6♡7♢= 19 points |
| Player's Hand | 2♠3♠4♠K♠8♢ = 19 points |

the hands are ties however the Dealer's Hand is declared the winner because the second highest ranked card, the 9♠is higher than the Player's 8♢. If all the cards of the hands have the same ranking the hands are declared a tie and the Player neither wins nor loses their wagers.

As a further feature, if the Player's Hand is a five card flush (all cards of the same suit) the Player's Hand is declared an automatic winner regardless of whether the Dealer's Hand has a higher point value.

As can be appreciated, the Player is playing against the Dealer for the ante wager and is playing to the pay Table 1 above for the call wager. A player can be paid at great odds in relation to the call wager depending upon the point value of their hand. This increases the excitement in relation to the game. Further the game is easy to understand and the Player need not know the particulars of Poker hand rankings or the like. Still further the game is fast paced since only one round of dealing is required.

With reference to the drawing, a further embodiment of the method of the present invention is shown. According to this embodiment, the method may be practiced using a gaming device. Alternatively the game could be player as a live, table game as well.

According to this embodiment, a device 10 is shown which includes a housing 12 having a video display 14 of conventional design. Disposed in the housing 12 is a processor having a data structure including data representing each card of a deck of fifty-two cards. Disposed below the display are actions buttons through which the Player controls the play of the game. From left to right in the drawing, button 16 is a cash out button, the depressing of which causes the processor to dispense any winnings accumulated as credits from the device 10. Buttons 18*a–e* control the holding or discarding of displayed cards as hereinafter described. Button 20 enables the Player to wager one accumulated credit at a time, button 22 enables the player make a maximum wager of credits to play the game, e.g. five credits and button 24 is a deal/draw button by which the player prompts the initial deal or completes play. Disposed above the display 14 is a paytable describing the payouts available to the Player. Disposed on the device 10 are means to accept a wager such as a coin or token slot 26. To make a wager, the Player inserts a coin into the slot 26 which is registered by the processor as a wager. Additionally or alternatively, a bill acceptor may be provided by which a Player may insert a cash bill which is accepted and results in the accumulation of credits available for wagering in the device corresponding to the amount of cash inserted.

To play the game the Player registers a wager by inserting a coin or wagering an accumulated credit. The Player then prompts play of the game. If the Player has made a maximum wager, play may be automatically prompted. Otherwise the Player depresses the deal/draw button 24. When play is prompted the processor randomly selects from the data structure data corresponding to five playing cards and displays representations of those cards at the display 14 as an initial holding shown as cards 28*a–e*. As an example the initial holding may be:

| |
|---|
| A♢K♢J♢4♤10♧ |

The Player assess the point value of initial holding according to the method described above. If the Player, based upon that assessment determines that he can better his initial holding point value by discarding one to five of the cards, the cards to be held (or discarded) are indicated by depressing the corresponding buttons 18*a–e*. In the above example, the Player would hold the A♢K♢J♢ since they have a point value sum of 31 and the remaining cards are of different suits. Depressing the deal/draw button 24 would prompt the processor to remove the cards to be discarded and would randomly select and display two more cards in tier place, such as, for example, 10♢Q♢. The displayed cards with the replacements, if any, constitutes the final holding. The processor determines the point value of the final holding and compares it to a paytable schedule stored in memory. If the point value of the final holding is at or greater than a predetermined value, the Player receives a payout, otherwise the Player's wager is lost. The point value paytable may be as shown in the following tables producing the approximate, indicated payback for the Player; i.e. the casino's vigourish= 1.0—payback.

TABLE 2

(1–4 coins wagered)

| Final Holding Value | Payout |
|---|---|
| 51 | 250 for 1 |
| 50 | 50 for 1 |
| 45–49 | 25 for 1 |
| 40–44 | 9 for 1 |
| 38–39 | 6 for 1 |
| 36–37 | 4 for 1 |
| 33–35 | 3 for 1 |
| 30–32 | 2 for 1 |
| 24–29 | 1 for 1 |
| <24 | Loss |
| Payback 93.7627% | |

TABLE 3

(5 coins wagered)

| Final Holding Value | Payout |
|---|---|
| 51 | 800 for 1 |
| 50 | 50 for 1 |
| 45–49 | 25 for 1 |
| 40–44 | 9 for 1 |
| 38–39 | 6 for 1 |
| 36–37 | 4 for 1 |
| 33–35 | 3 for 1 |
| 30–32 | 2 for 1 |
| 24–29 | 1 for 1 |
| <24 | Loss |
| Payback 95.4123% | |

TABLE 4

(1–4 coins wagered)

| Final Holding Value | Payout |
|---|---|
| 51 | 250 for 1 |
| 50 | 50 for 1 |
| 45–49 | 25 for 1 |
| 41–44 | 9 for 1 |
| 38–40 | 6 for 1 |
| 36–37 | 4 for 1 |
| 33–35 | 3 for 1 |
| 29–32 | 2 for 1 |
| 24–28 | 1 for 1 |
| <24 | Loss |
| Payback 96.43% | |

TABLE 5

(5 coins wagered)

| Final Value | Payout |
|---|---|
| 51 | 800 for 1 |
| 50 | 50 for 1 |
| 45–49 | 25 for 1 |
| 41–44 | 9 for 1 |
| 38–40 | 6 for 1 |
| 36–37 | 4 for 1 |
| 33–35 | 3 for 1 |
| 29–32 | 2 for 1 |
| 24–28 | 1 for 1 |
| <24 | Loss |
| Payback 98.0794% | |

Tables 2 and 3 are related in that Table 3 is where the Player makes a maximum wager of 5 coins or credits. Tables 4 and 5 are similarly related.

By selecting the desired payout schedule, the payback and vigourish can be changed. It is to be understood that other payout schedules could be used as well. According the example, since the player has a point total of fifty-one, if the schedule of Table 5 is used and the Player wagered $5, he would be paid $4000.

As can be appreciated, the game according to the methods of the present invention is easy to understand and can result in large payoffs which contributes to the excitement of the game.

While I have shown and described certain embodiments of the present invention it is to be understood that it is subject to many modifications without departing from the spirit and scope of the claims.

I claim:

1. A method for playing a game between a Dealer and a Player using a deck of playing cards comprising:

the player making an ante wager to participate in the game;

dealing five cards as a Dealer's Hand and five cards as the Player's Hand, each of said hands having a value determined by the suit of the highest summed point value where, (1) Kings, Queens and Jacks count as 10 points, (2) Aces count as 11 points, and (3) all other cards have a point count corresponding to their face value;

the Player placing a call bet to continue play or folding, if the Player folds the Player's Hand declared the loser and losing his ante wager;

resolving the Dealer's Hand against the Player's Hand according to the following rules, (1) if the Dealer's Hand does not have a qualifying value of at least a predetermined amount, the Player's Hand declared the winner, (2) if the Player's Hand has a higher value than the Dealer's Hand, the Player's hand declared the winner, (3) if the Player's and Dealer's Hand having the same value, the hands declared a tie; and paying the Player based upon their wagers when the Player's Hand is declared the winner, not paying or collecting the wager when there is a tie and collecting the Player's wagers when the Player's Hand is not declared the winner.

2. The method of claim 1 including selecting a value of 18 for the Dealer's Hand qualifying value.

3. The method of claim 1 including, where the Player's hand is declared the winner, paying the Player 1:1 for their ante wager according to the schedule of Table 1 for their call bet

TABLE 1

| Player's Hand Value | Payout |
|---|---|
| 51 | 100:1 |
| 50 | 50:1 |
| 47–49 | 20:1 |
| 42–46 | 10:1 |
| 40–41 | 7:1 |
| 35–39 | 5:1 |
| 32–34 | 3:1 |
| 29–31 | 2:1 |
| 18–28 | 1:1 |

4. The method of claim 1 further including declaring a Player's Hand of a five card flush and automatic winner.

5. The method of claim 4 further including, where the Dealer's Hand does not have a qualifying value, paying the Player whose Player's Hand is a five card flush 1:1 for their ante wager and returning the call wager.

6. The method of claim 1 including resolving tie hands by comparing the ranking of cards, declaring the hand with the highest ranking card the winner where the cards are ranked according to the following schedule

| Card Ranking Schedule |
|---|
| 1. Ace (highest ranked card) |
| 2. King, Queen, Jack, 10 (ranked the same) |
| 3. 9's |
| 4. 8's |

-continued

| Card Ranking Schedule |
|---|
| 5. 7's |
| 6. 6's |
| 7. 5's |
| 8. 4's |
| 9. 3's |
| 10. 2's (lowest ranked card) |

7. A method for playing a game between a Dealer and a Player using a deck of playing cards comprising:

the player making an ante wager to participate in the game;

dealing five cards as a Dealer's Hand and five cards as the Player's Hand, each of said hands having a value determined by the suit of the highest summed point value where, (1) Kings, Queens and Jacks count as 10 points, (2) Aces count as 11 points, and (3) all other cards have a point count corresponding to their face value;

the Player placing a call bet at an amount twice their ante wager to continue play or folding, if the Player folds the Player's Hand declared the loser and losing his ante wager;

resolving the Dealer's Hand against the Player's Hand according to the following rules, (1) if the Dealer's Hand does not have a qualifying value of at least 18 points, the Player's Hand declared the winner, (2) if the Player's Hand has a higher value than the Dealer's Hand, the Player's hand declared the winner, (3) if the Player's and Dealer's Hand having the same value, the hands declared a tie, (4) comparing, for tie Hands, the card rankings to determine the winner, if said Hands have the same ranking of cards, declaring the Hands a tie, and (5) if the Player's Hand is a five card flush, declaring the Player's hand an winner regardless of the value of the Dealer's Hand paying the Player based upon their wagers when the Player's Hand is declared the winner, not paying or collecting the wager when there is a tie and collecting the Player's wagers when the Player's Hand is not declared the winner, the Player paid for winners at 1:1 for their ante wager and according to the following schedule of Table 1 for his call wager

TABLE 1

| Player's Hand Value | Payout |
|---|---|
| 51 | 100:1 |
| 50 | 50:1 |
| 47–49 | 20:1 |
| 42–46 | 10:1 |
| 40–41 | 7:1 |
| 35–39 | 5:1 |
| 32–34 | 3:1 |
| 29–31 | 2:1 |
| 18–28 | 1:1 |

8. A method for a Player to play a game using playing cards comprising:

(1) the player making a wager;

(2) dealing five cards to the Player to define an initial holding having a value determined by the suit of the highest summed point value where, (A) Kings, Queens and Jacks count as 10 points, (B) Aces count as 11 points, and (C) all other cards have a point count corresponding to their face value;

(3) the Player opting to discard 0–5 of the cards of the initial holding and replacing any discarded cards with replacements to define a final holding having a final value;

(4) if the final value exceeds a preselected amount, paying the player based upon their wager.

9. The method of claim 8 including paying the Player based upon the schedule of Table 2.

TABLE 2

| Final Value | Payout |
|---|---|
| 51 | 250 for 1 |
| 50 | 50 for 1 |
| 45–49 | 25 for 1 |
| 40–44 | 9 for 1 |
| 38–39 | 6 for 1 |
| 36–37 | 4 for 1 |
| 33–35 | 3 for 1 |
| 30–32 | 2 for 1 |
| 24–29 | 1 for 1 |
| <24 | Loss |

10. The method of claim 8 including paying the Player based upon the schedule of Table 3.

TABLE 3

| Final Value | Payout |
|---|---|
| 51 | 800 for 1 |
| 50 | 50 for 1 |
| 45–49 | 25 for 1 |
| 40–44 | 9 for 1 |
| 38–39 | 6 for 1 |
| 36–37 | 4 for 1 |
| 33–35 | 3 for 1 |
| 30–32 | 2 for 1 |

TABLE 3-continued

| Final Value | Payout |
|---|---|
| 24–29 | 1 for 1 |
| <24 | Loss |

11. The method of claim 8 including paying the Player based upon the schedule of Table 4.

TABLE 4

| Final Value | Payout |
|---|---|
| 51 | 250 for 1 |
| 50 | 50 for 1 |
| 45–49 | 25 for 1 |
| 41–44 | 9 for 1 |
| 38–40 | 6 for 1 |
| 36–37 | 4 for 1 |
| 33–35 | 3 for 1 |
| 29–32 | 2 for 1 |
| 24–28 | 1 for 1 |
| <24 | Loss |

12. The method of claim 8 including paying the Player based upon the schedule of Table 5.

TABLE 5

| Final Value | Payout |
|---|---|
| 51 | 800 for 1 |
| 50 | 50 for 1 |
| 45–49 | 25 for 1 |
| 41–44 | 9 for 1 |
| 38–40 | 6 for 1 |
| 36–37 | 4 for 1 |
| 33–35 | 3 for 1 |
| 29–32 | 2 for 1 |
| 24–28 | 1 for 1 |
| <24 | Loss |

* * * * *